United States Patent [19]

Lin

[11] Patent Number: 4,877,045

[45] Date of Patent: Oct. 31, 1989

[54] PIVOTAL POSITIONING MEANS FOR USE IN BEACH UMBRELLA

[75] Inventor: Chia-Hui Lin, Chiayi Hsien, Taiwan

[73] Assignee: Tai Yu Enterprise Co., Ltd., Chiayi Hsien, Taiwan

[21] Appl. No.: 228,668

[22] Filed: Aug. 3, 1988

[51] Int. Cl.[4] ..... A45B 17/00

[52] U.S. Cl. ..... 135/20 M; 135/74

[58] Field of Search ..... 135/20 R, 20 A, 20 M, 135/74

[56] References Cited

U.S. PATENT DOCUMENTS 3,419,295 12/1968 Small ..... 135/20 M
3,489,157 1/1970 Pearlstine ..... 135/74

FOREIGN PATENT DOCUMENTS 2529240 1/1976 Fed. Rep. of Germany ..... 135/74
286294 10/1952 Switzerland ..... 135/74

*Primary Examiner*—Carl D. Friedman

*Assistant Examiner*—Caroline D. Dennison

[57] ABSTRACT

The present disclosure is related to an improved pivotal positioning member for use as a joining knuckle of a shade, and particularly for a large beach umbrella. The pivotal positioning member includes an upper element and a lower element pivotally joined by a pin. The upper element is provided with a projection block on each side thereof which is slidably engaged with an arcuate groove defined on the top edge of each upright lug of the lower element; and at the bottom end of the upper element is disposed a number of positioning grooves which will be in selective engagement with the front end of a spring-biased locking piece mounted on the lower element so that the tilted upper element can be firmly fixed in a selective place with the opened canopy tilted at a desired angle, and the canopy will not be overtilted in operation as a result of the restraint of the projection block in association with the arcuate groove.

2 Claims, 2 Drawing Sheets

FIG.1-A

PIVOTAL POSITIONING MEANS FOR USE IN BEACH UMBRELLA

BACKGROUND OF THE INVENTION

1. Field of the Invention

The present invention is related to a pivotal positioning member adopted for use in a shade or large beach umbrella, permitting the selective tilting of the opened canopy at a proper angle and firm fixing of the sme in that position without ready disengagement. The present positioning member includes an upper element and a lower element, and a spring biased locking piece and is characterized by the projection block disposed on each outer side of the upper element and the corresponding arcuate groove defined on each inner side of the upright lugs of the lower element, the present positioning member can be operated in a more stable and precise manner as a result of the projection block being in restraining engagement with the arcuate groove in assembly.

2. The Prior Art

In the prior art structures of this kind of pivotal positioning means, only the spring biased locking piece is used to fix the tilted canopy in position, and no other supporting element is adopted. Therefore the tilted canopy can be easily disengaged from the fixed position. To make an improvement on the prior art, the inventor has worked out a pivotal positioning means to eliminate the above mentioned disadvantage.

SUMMARY OF THE INVENTION

The primary object of the present invention is to provide an improved pivotal positioning member adopted for use in a shade or large beach umbrella, which is comprised of an upper element and a lower element assembled together by a resilient locking piece as well as a pivot pin. The upper element is provided with a projection block on each side thereof slidably fitted into an arcuate groove disposed on the inner side of the upright lugs of the upper element when assembled; and the spring biased locking piece having a key-like structure with the front end in selective engagement with one of the spacedly arranged grooves so to lock the tilted canopy in place in a more secure and firm manner.

BRIEF DESCRIPTION OF THE DRAWINGS

To better illustrate the operation mode and features of the structure of the present pivotal positioning means, a number of drawings are provided in company with a detailed description of the present invention, in which:

FIG. 1*a* is a diagram showing the other side of the upper element, viewed in the direction indicated by the arrow A;

DETAILED DESCRIPTION OF THE PREFERRED EMBODIMENT

Figure 1:
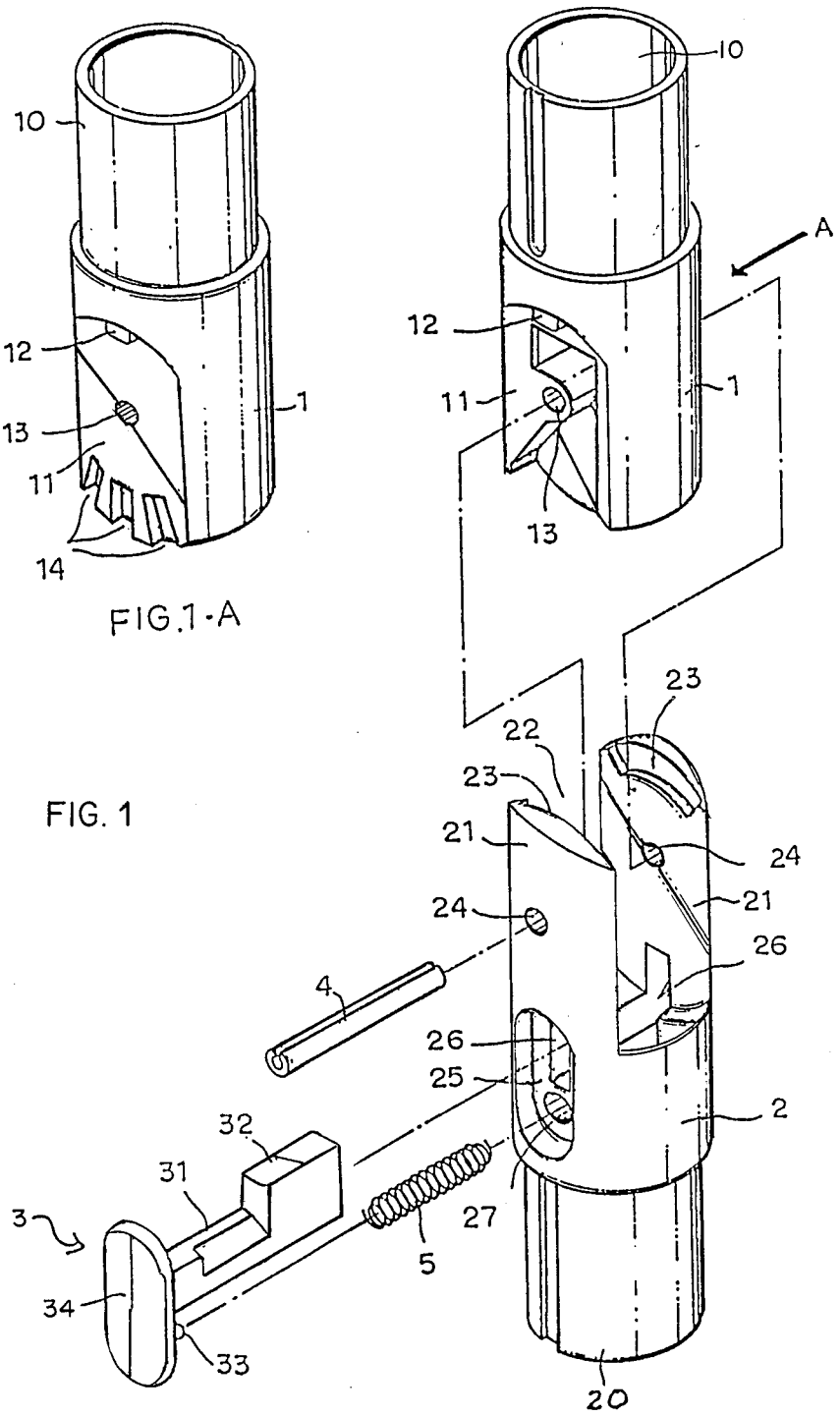
FIG. 1 is a diagram showing the exploded components of the present invention.

Referring to FIG. 1, the pivotable positioning member includes an upper element 1 and a lower elemetn 2, both of which are structured in a tubular form. The upper element 1 has a hollow tube 10 attached at the top thereof, and the lower element 2 is also provided with a hollow tube 20 at the bottom thereof so that the pole of the umbrella or shade can be engaged with the positioning member from both ends thereof.

The tubular upper element 1 is, in connection with the hollow tube 10 with the two opposite walls thereof, formed in a flat form and a through hole 13 is disposed at the central portion thereof. At the bottom edge of the tubular element 1, on one of the flattened walls, there are disposed a number of spaced positioning grooves 14; and at the top edge of each flattened wall, a projection block 12 is located.

The lower element 2 is in connection with a hollow tube 20 which is adapted to receive the pole of the umbrella therein in assembly. The lower element 2 is basically structured in tubular form with two opposite walls removed to form a pair of symmetric lugs. On the middle of the two lugs, there are disposed a through hole 24; and on the inner side of each lug 21 and at the top edge thereof, an arcuate groove 23 is disposed, which is in relatively slidable engagement with the projection block 12 in assembly.

The upper element 1 having two opposite flattened walls, with one provided with a projected and flat engaging portion 11, is placed in the slot 22 formed between the two lugs 21, and the coupled two elements are pivotally engaged together by means of a pivot pin 4 located through the holes 13, 24.

A key-shaped locking piece 3 has a front engagement end 32, a connecting portion 31 and a button end 34 on the inner side of which is disposed a protrusion 33 for the mounting of a spring 5. The bottom portion of the lower element 2 is structured in accordance with the locking piece 3, having a through slot 26, a counter sink 25 disposed on the wall and a deep hole 27 with the spring 5 received therein. As is clear from FIG. 1, the locking piece 3 is adapted to fit in the through slot or groove 26 of the lower element 2. The button end 34 of the locking piece 3, upon full insertion of the locking piece 3 into the lower element 2, fits in the counter sink 25.

Figure 2:
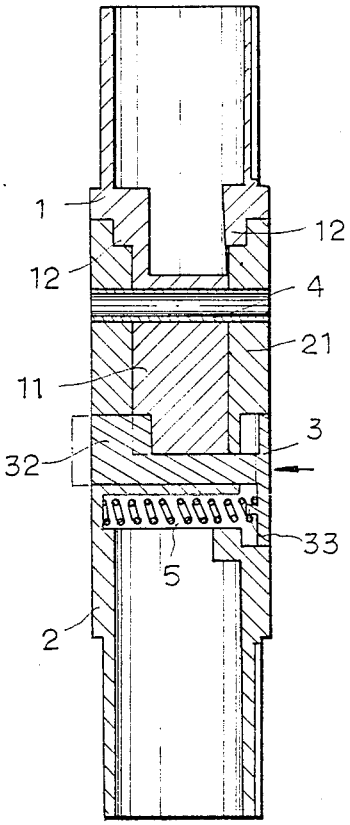
FIG. 2 is a sectional view of the assembled structure of the present invention.

Referring to FIG. 2, the sectional view shows the assembled upper and lower elements 1, 2 with the locking piece 3 mounted thereon. By pressing the button end of the locking piece 3, the same will move against the spring 5 and the front engagement end will be disengaged from the positioning groove 14, permitting the pivotal movement of the upper element 1 with respect to the lower element 2 as shown in FIG. 3.

Figure 3:
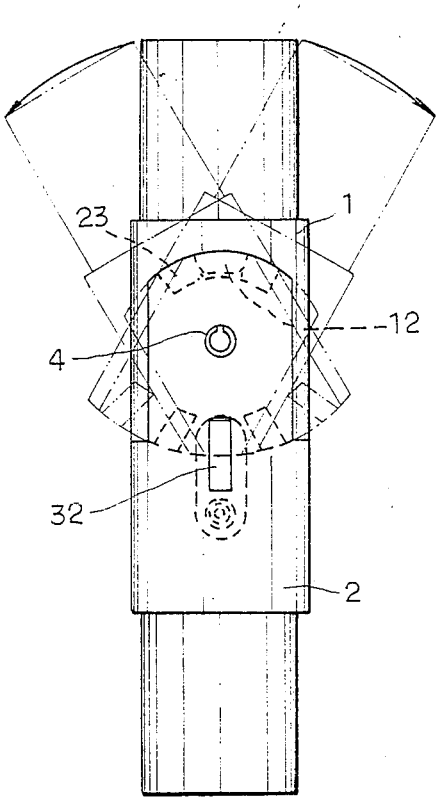
FIG. 3 is a side view showing the pivotal operation of the upper element with respect to the lower element.

As shown in FIG. 3, the projection block 12 of the upper element 1 is in slidable engagement with the arcuate groove 23 and the range of the pivotal movment of the upper element 1 is effectively limited in the tilting operation.

While there have been described what are at present considered to be the preferred embodiment of this invention, it will be obvious to those skilled in the art that various changes and modifications may be made therein without departing from the invention, and it is, therefore aimed, to cover all such changes and modifications as fall within the true spirit and scope of the invention.

I claim:

1. An improved pivotal positioning means for use as a joining knuckle of a shade or beach umbrella, comprising:

an upper element having a tubular shape with two opposite walls defined in flattened manner, one of the flattened walls being provided with a projected, flat engaging portion;

a through hole defined through the central portion of the upper element;

a plurality of spaced positioning grooves disposed a bottom edge of the other flattened wall;

a projection block disposed at a top edge of each of said flattened walls;

a hollow tube disposed in connection with a top end of said upper element;

a lower element having a tubular shape with a pair of upright lugs, and a slot being defined between said lugs so that said upper element can be received therein in assembly;

a countersink disposed near the bottom end of one of said lugs;

a groove defined right behind said countersink and through the lower element;

a deep hole disposed right below said groove;

an arcuate groove disposed at a top edge of each of said lugs for slideable engagement with said projection block in assembly;

a pivot pin for placement through the through holes of the upper and lower elements in assembly so to permit the pivotal movement of said upper element with respect to the lower element;

a locking piece adapted to be inserted into said groove in said lower element for selective engagement in said positioning grooves, said locking piece having a front engagement end, a button end and a connecting portion between said front engagement end and said button end, said button end being adapted to be received in said counter sink and having a protrusion on an inner side thereof;

a spring having a first end adapted to be in engagement with said protrusion of said button end of said locking piece, and a second end adapted to be received in said deep hole of said lower element;

wherein the projection block of said upper element and said arcuate groove of said lower element in combination constitute said pivotal positioning means, which are able to limit the pivot angle of the upper element with respect to the lower element so that the over-tilting of the canopy can be prevented and the tilting operation can be performed in a more precise manner.

2. The pivotal positioning means according to claim 1, wherein said arcuate grooves in said upright lugs have closed ends.

* * * * *